US008094861B2

(12) United States Patent
Liu

(10) Patent No.: US 8,094,861 B2
(45) Date of Patent: Jan. 10, 2012

(54) SPEAKER

(76) Inventor: Nien-Tzu Liu, Taipei (TW)

( * ) Notice: Subject to any disclaimer, the term of this patent is extended or adjusted under 35 U.S.C. 154(b) by 875 days.

(21) Appl. No.: 12/141,659

(22) Filed: Jun. 18, 2008

(65) Prior Publication Data

US 2009/0316947 A1 Dec. 24, 2009

(51) Int. Cl.
*H04R 25/00* (2006.01)

(52) U.S. Cl. ..... 381/394; 381/345; 381/386

(58) Field of Classification Search ..... 381/345, 381/347–348, 370–371, 374, 384, 386–389, 381/394, 395
See application file for complete search history.

(56) References Cited

U.S. PATENT DOCUMENTS 4,086,445 A * 4/1978 Robinson ..... 381/345
5,689,573 A * 11/1997 Jones ..... 381/345
6,968,069 B1 * 11/2005 Zhao ..... 381/345
7,201,252 B2 * 4/2007 Nevill ..... 381/345

* cited by examiner

*Primary Examiner* — Suhan Ni
(74) *Attorney, Agent, or Firm* — The Weintraub Group, P.L.C.

(57) ABSTRACT

The present invention relates to a speaker, comprises a housing having a top housing cap and a bottom housing cabinet. The top housing cap with a plurality of through slots are provided on the top housing cap and the bottom housing cabinet which provides with an accommodating space; a speaker unit having a bowl-shaped seat; an amplifying circuit; an USB cable for gaining the required power; an audio cable for obtaining audio signals; a cup-shaped cabinet that can be provided on the bottom housing cabinet, so a space where a resonating effect can be generated is defined between the bowl-shaped seat of the speaker unit and the cup-shaped cabinet, therefore vibrations generated by the speaker unit is transferred to an output of good-quality sound effect.

10 Claims, 4 Drawing Sheets

SPEAKER

BACKGROUND OF THE INVENTION

1. Field of the Invention

The present invention relates to a speaker, more particularly to a speaker having a round-shaped housing on which can use a cup-shaped cabinet made of paper, plastic or metal that provides so as to be a reverberation space thus sound wave generated by the speaker can be resonated via the reverberation space for outputting a good-quality sound effect.

2. Description of Related Art

The current multi-media speaker industries, plays music or songs for personal computer attached CD or a DVD player, MP3, MP4 etc. Or through the matured technology of internet allows a user to directly download or display a media file. This allows users can display the files for entertainment or necessary operations like a demonstration.

In the computer or MP3 related markets, the current speakers with different styles and sizes, Most often a resonating cabinet case is to generate a proper sound effect, in most cases large in size and not easy to be carried around. A portable device pattern shall be for a more convenient usage. A "Cup" is available and handy with easy in all places, said; a used McDonald cold drink or a Startbucks coffee cup.

SUMMARY OF THE INVENTION

One object of the present invention is to provide a speaker that adopt to a "Cup", which to be used as a resonating case.

Another subject of the present invention is to provide a speaker that can be powered via an USB cable for convinent usage as a prepheral of laptop device.

For achieving the objects mentioned above, the speaker provided by this invention includes: a speaker module composed of a top housing cap and a bottom cabinet that hold a speaker driver unit and an amplifier PCB assembly underneath, slots of the cap let the sound wave generated by speaker driver goes out to resonate space/a cup, The cabinet housing hold the speaker driver and amplifier PCB assembly in place. A speaker driver unit connected to PCB; an amplifying PCB circuit transfer sound signals received to be enlarged and therefor drive the speaker driver to produce sound. An USB cable, lead in the 5 Volt power source, (or digital signal for decoding into analog signals), one end of the USB cable is coupled with the amplifying circuit and the other end thereof is coupled with an USB device plug; an audio cable, one end of the audio cable is coupled with the amplifying circuit and the 3.5 mm plug end thereof is coupled with a displaying device for obtaining audio signals.

The module can be put on a cup-shaped device (a paper, plastic, metal or ceramic cup) that the space inbetween the speaker module and inner side of cup, can be provided as resonate cabinet generates good performance of sound output. Or, the module can be insert into the open end of a cup-shaped device (a paper, plastic, metal or ceramic cup), therefore to form a sound output device.

DETAILED DESCRIPTION OF THE PREFERRED EMBODIMENT

Figure 1:
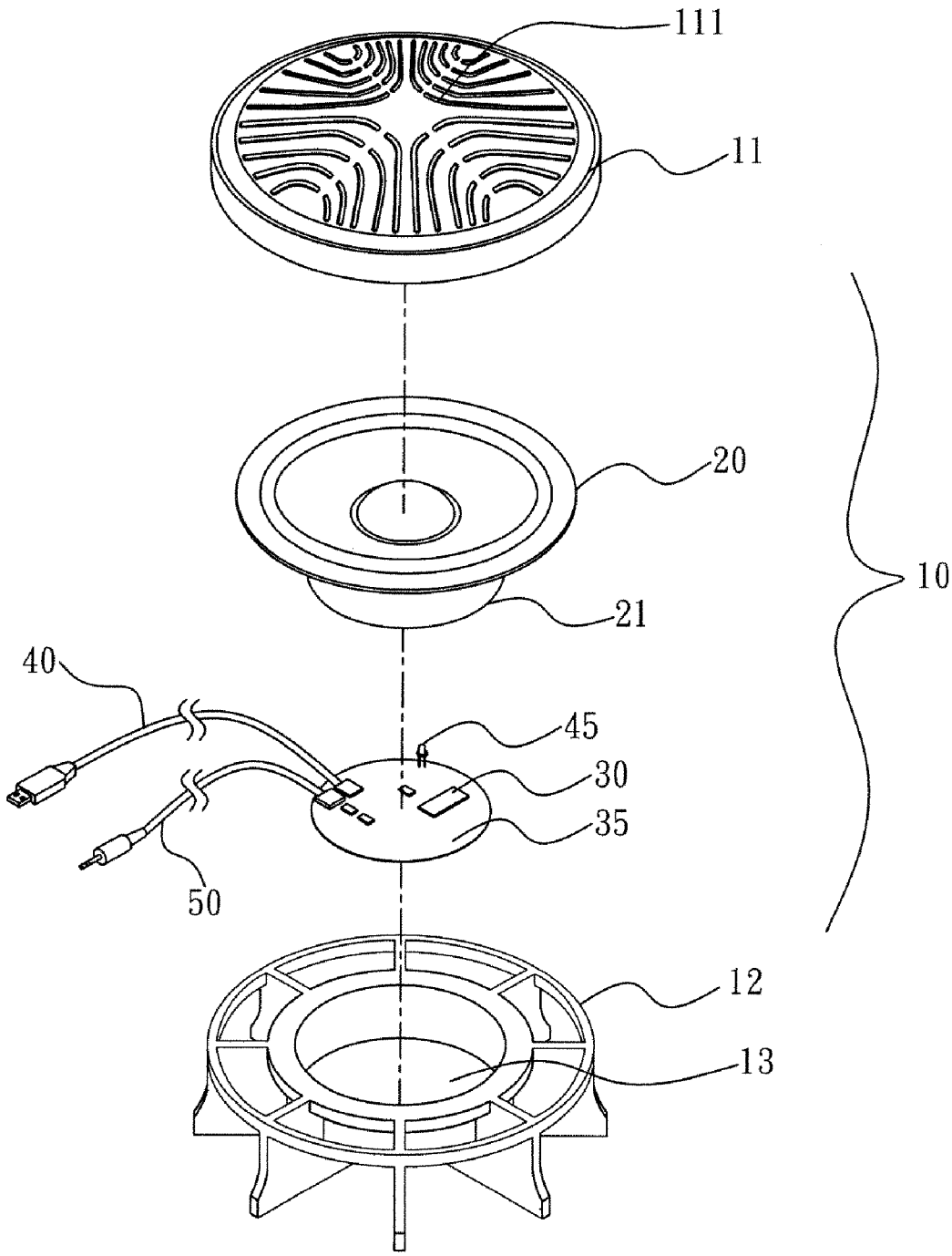
FIG. 1 is a drawing of exploded view of a speaker of one preferred embodiment provided by the invention.
Figure 2:
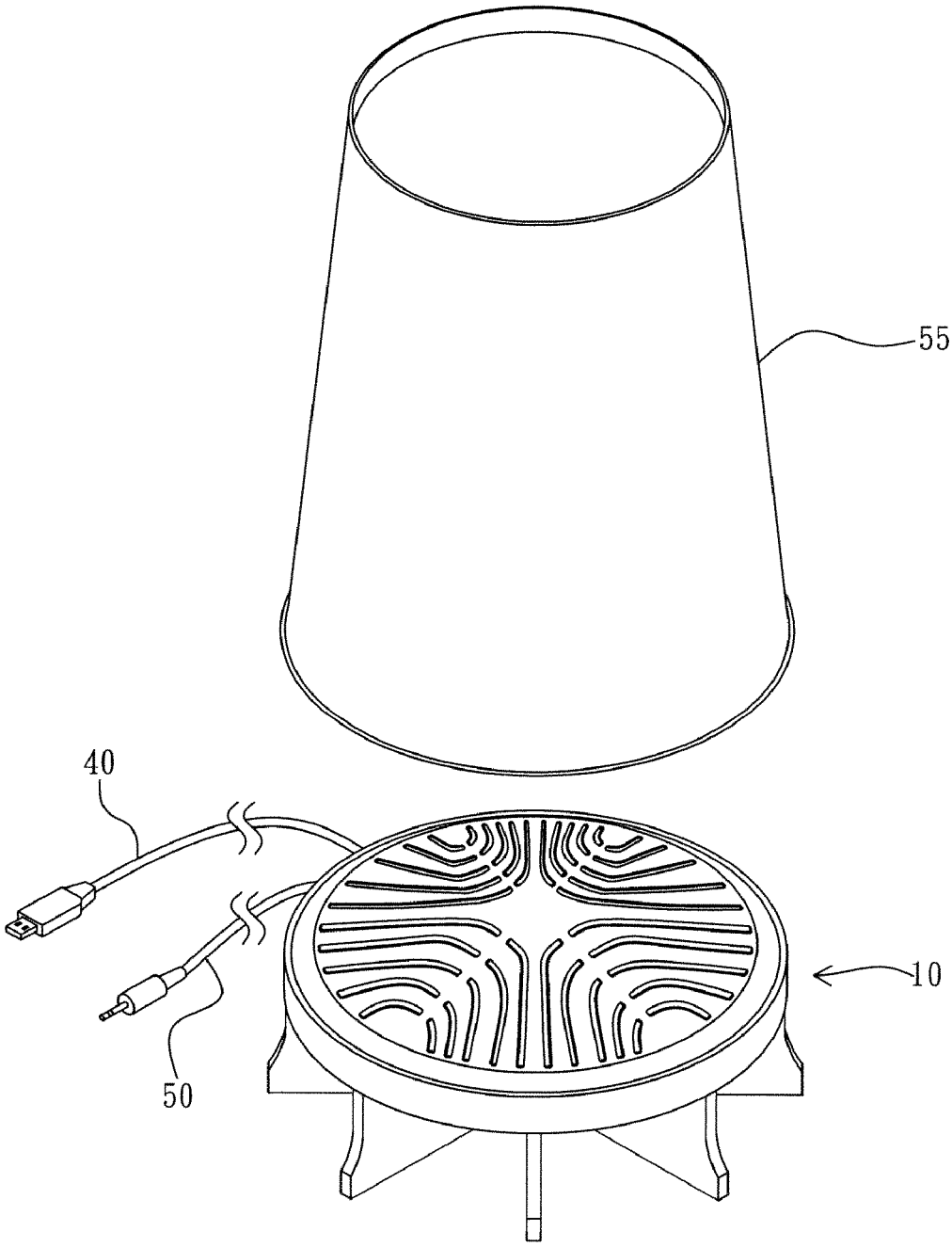
FIG. 2 is a drawing of assembled view of the speaker of one preferred embodiment provided by the present invention.
Figure 3:
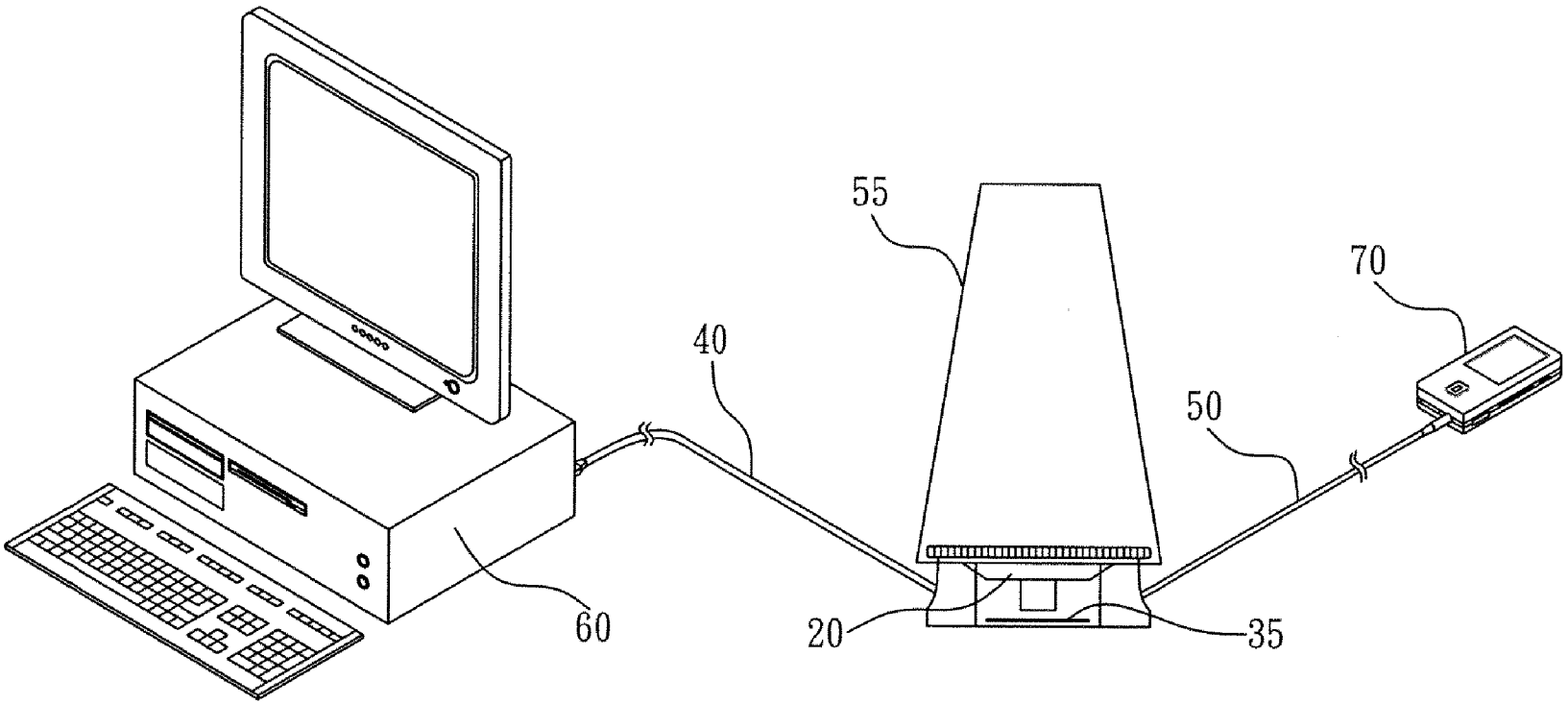
FIG. 3 is a drawing of the speaker provided by the present invention being provided with a cup-shaped device.

Referring to FIG. 1 to FIG. 3, the speaker provided by the present invention includes a housing 10; a speaker unit 20; an amplifying circuit 30; an USB cable 40 and an audio cable 50.

The housing 10 is provided with a top housing cap 11 and a bottom housing cabinet 12 that can be engaged with the top housing cap 11, a plurality of through slots 111 are provided on the top housing cap 11 for outputting sound wave from the speaker unit 20, the bottom housing cabinet 12 is provided with an accommodating space 13 for receiving the speaker unit 20 and the amplifying circuit 30, the shape of the accommodating space 13 can be, but not limited to, a round shape and made of plastic materials.

The speaker unit 20 is received in the accommodating space 13 and is provided with a bowl-shaped seat 21.

The amplifying circuit 30 is received in the accommodating space 13, e.g., but not limited to, being received in the bottom portion of the bottom housing cabinet 12, and the amplifying unit 30 is coupled with the speaker unit 20 and is served to amplify audio signals then output to the speaker unit 20 for generating sound, the amplifying circuit 30 can be, but not limited to, a transistor circuit or an integrated circuit. The speaker provided by the present invention is further provided with a printed circuit board 35 that is disposed at the bottom portion of the bottom housing cabinet 12 and beneath the speaker unit 20 for carrying the amplifying circuit 30.

One end of the USB cable 40 is coupled with the amplifying circuit 30 and the other end thereof is coupled with an USB device 60 for obtaining the required power; wherein the USB device 60 can be, but not limited to, a computer or a portable electronic device having USB ports, a computer is adopted in the embodiment for illustration, so a DC power source can be coupled with the amplifying circuit 30 via the USB cable 40 for providing the required electrical power, therefore a rectifying circuit or a chamber for accommodating batteries are needless, so the height of the housing 10 provided by the present invention is reduced and shall be more easily to be carried around. The speaker provided by the present invention is further provided with an indicating device 45, e.g., but not limited to, a LED, that is coupled with the USB cable 40 and is exposed outside of the through slots 111 and can be served to indicate the power status.

One end of the audio cable 50 is coupled with the amplifying circuit 30, the other end there of is couple with a displaying device 70 for obtain audio signals, wherein the displaying device 70 can be, but not limited to, a CD player, a MP3 player or any other device capable of displaying music.

As shown in FIG. 2, the speaker provided by the present invention is further provided with a cup-shaped cabinet 55 on the housing 10, so a space where a resonating effect can be generated between the bowl-shaped seat 21 of the speaker unit 20 and the cup-shaped cabinet 55 is defined, sound wave vibrations generated by the speaker unit 20 are therefore transferred to a good-quality audio output. The material that the cup-shaped cabinet 55 is made of can be, but not limited to, papers, plastic, metal, or ceramic materials, wherein the diameter of the opening of the cup-shaped cab 55 is slightly larger than the outer diameter of the housing 10, so the cup-shaped cabinet 55 can be provided at the outer periphery of the housing 10, a sealed resonating space is therefore obtained between the cup-shaped cabinet 55 and the housing 10 so as to achieve a better resonating effect. The cup-shaped cabinet 55 can be replaced according to the moods of the users therefore a function of environmental friendly is also achieved.

As shown in FIG. 3, when operating, one end of the USB cable 40 provided by the present invention is coupled with the USB device 60, e.g. a computer, then the indicating device 45 is lit for indicating the required power is gained; one end of the audio cable 50 is coupled with the displaying device 70; then the cup-shaped cabinet 55 is inserted on top of the housing 10 so a sealed resonating space between the cup-shaped cabinet 55 and the housing 10 is obtained, the assembly and the effects generated are better than conventional speakers.

Figure 4:
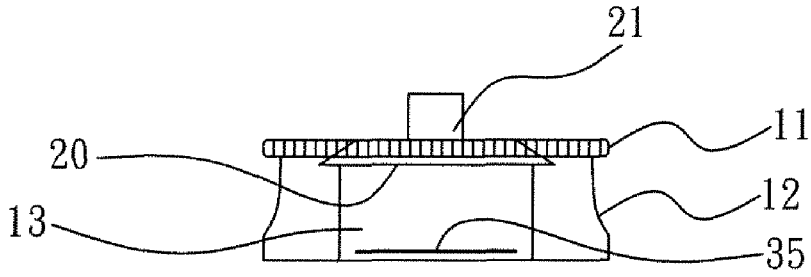
FIG. 4 is a drawing of assembled view of a speaker of another preferred embodiment provided by the present invention.
Figure 5:
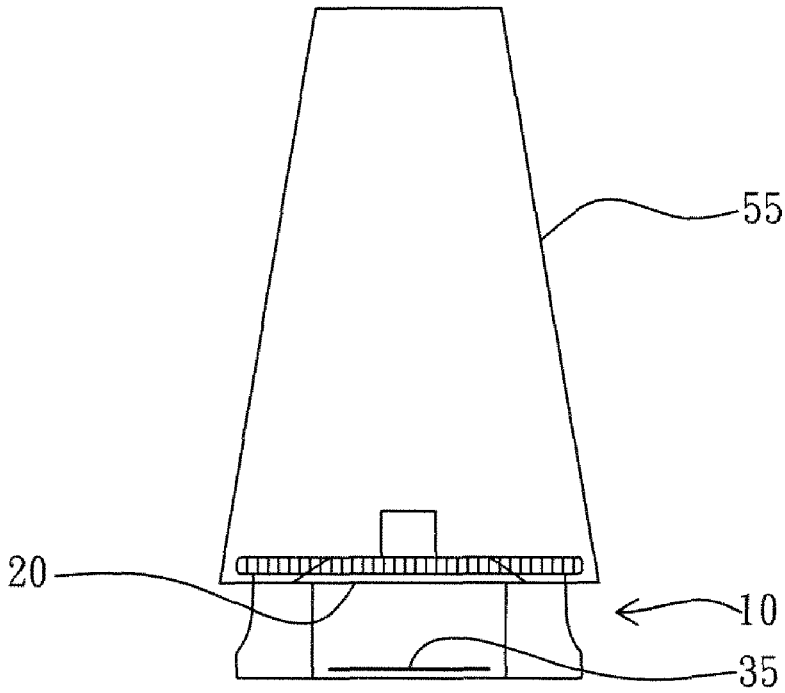
FIG. 5 is a drawing of the speaker of another preferred embodiment provided by the present invention being provided with a cup-shaped cabinet.

Referring to FIG. 4 and FIG. 5, wherein FIG. 4 is a drawing of assembled view of a speaker of another preferred embodiment provided by the present invention; FIG. 5 is a view of the speaker of another preferred embodiment provided by the present invention being provided with a cup-shaped cabinet.

As shown in figures, when operating, the bowl-shaped seat 21 of the speaker unit 20 whose top surface is downwardly faced is provided on the bottom housing cabinet 12, then the cup-shaped cabinet 55 is provided on the top housing cap 11, so a resonating space is defined between the bowl-shaped seat 21 of the speaker unit 20 and the cup-shaped cabinet 55 for generating a resonating effect in the defined space, sound wave vibrations generated by the speaker unit 20 are then transferred to a good-quality sound effect.

According to the embodiments described above, the speaker provided by the present invention does not need an attached resonating case, the required power can be gained via an USB cable therefore the size of the speaker is reduced.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprises:

A housing having a top housing cap and a bottom cabinet that can be engaged with the top housing cap, a plurality of through slots are provided on the top housing cap and the bottom cabinet is provided with an accommodating space;

A speaker unit received in the accommodating space and having a bowl-shaped seat; an amplifying circuit received in the accommodating space and coupled with the speaker unit; an USB cable, one end of the USB cable is coupled with the amplifying circuit and the other end thereof is coupled with an USB device for gaining the required power; an audio cable, one end of the audio cable is coupled with the amplifying circuit and the other end thereof is coupled with a displaying device for obtaining audio signals; and a cup-shaped cabinet that can provide a space where a resonating effect can be generated is defined between the bowl-shaped seat of the speaker unit and the cup-shaped cabinet, therefore vibrations generated by the speaker unit is transferred to an output of good-quality sound effect.

2. The speaker as claimed in claim 1, wherein the housing is in a round shape and is made of plastic materials.

3. The speaker as claimed in claim 1, wherein the bowl shaped seat of the speaker unit is provided on the bottom housing cabinet in a means that the top surface of the bowl shaped seat is upwardly faced or in a means that top surface of the bowl shaped seat is downwardly faced.

4. The speaker as claimed in claim 1, wherein the amplifying circuit is provided at the bottom portion of the bottom housing cabinet.

5. The speaker as claimed in claim 1, wherein the amplifying circuit is a transistor circuit or an integrated circuit.

6. The speaker as claimed in claim 1, wherein the displaying device is a CD player, a MP3 displaying device or any other device capable of displaying music.

7. The speaker as claimed in claim 1, wherein the cup-shaped cabinet is made of paper, plastic, metal or ceramic material.

8. The speaker as claimed in claim 1, wherein the USB device is a computer or a portable electronic device.

9. The speaker as claimed in claim 1, wherein an indicating device is further provided to the speaker, the indicating device is coupled with the USB cable and is exposed outside of the through slots for indicating the power status.

10. The speaker as claimed in claim 1, wherein a printed circuit is further provided to the speaker, the printed circuit board is provided at the bottom portion of the bottom housing cabinet for carrying the amplifying circuit.

* * * * *